US010247466B2

(12) United States Patent
Tao et al.

(10) Patent No.: US 10,247,466 B2
(45) Date of Patent: Apr. 2, 2019

(54) FREEZING AND REFRIGERATING DEVICE AND DEFROSTING CONTROL METHOD THEREOF

(71) Applicant: QINGDAO HAIER JOINT STOCK CO., LTD., Qingdao, Shandong Province (CN)

(72) Inventors: Haibo Tao, Qingdao (CN); Jianru Liu, Qingdao (CN); Feifei Qi, Qingdao (CN); Lisheng Ji, Qingdao (CN)

(73) Assignee: QINDAO HAIER JOINT STOCK CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 15/523,367

(22) PCT Filed: Oct. 30, 2015

(86) PCT No.: PCT/CN2015/093403

§ 371 (c)(1),
(2) Date: Apr. 29, 2017

(87) PCT Pub. No.: WO2016/173227

PCT Pub. Date: Nov. 3, 2016

(65) Prior Publication Data

US 2017/0248360 A1 Aug. 31, 2017

(30) Foreign Application Priority Data

Apr. 29, 2015 (CN) ..... 2015 1 0215962

(51) Int. Cl.
*F25D 11/00* (2006.01)
*F25D 11/02* (2006.01)
(Continued)

(52) U.S. Cl.
CPC ..... *F25D 21/06* (2013.01); *F25D 11/00* (2013.01); *F25D 11/02* (2013.01); *F25D 17/062* (2013.01);
(Continued)

(58) Field of Classification Search
CPC ..... F25D 21/08; F25D 21/14; F25D 11/00; F25D 17/065; F25D 2700/10
(Continued)

(56) References Cited

U.S. PATENT DOCUMENTS 5,713,215 A * 2/1998 Choi ..... F25D 17/065 62/419
5,787,725 A * 8/1998 Shin ..... F25D 17/065 62/276
2012/0017630 A1* 1/2012 Okabe ..... B05B 5/16 62/407

FOREIGN PATENT DOCUMENTS

CN 1204041 A 1/1999
CN 104792094 A 7/2015
(Continued)

*Primary Examiner* — Cassey D Bauer
(74) *Attorney, Agent, or Firm* — Cheng-Ju Chiang

(57) ABSTRACT

A freezing and refrigerating device comprises a box body and a door body. An air supply path supplying cooling air flow to a storage compartment, an air return path enabling the air flow from the storage compartment to pass, a cooling chamber and a defrosting air return path are defined in the box body, wherein the cooling chamber is provided with an air feeding opening part and an air return opening part and contains an evaporator, a blower and a defrosting heater, and the defrosting air return path is communicated with the air feeding opening part and the air return opening part of the cooling chamber. The air supply path and the defrosting air return path are provided with an air supply door and a
(Continued)

defrosting air return door respectively. The present invention further provides a defrosting control method of the freezing and refrigerating device.

4 Claims, 5 Drawing Sheets

(51) Int. Cl.

| | |
|---|---|
| ***F25D 17/04*** | (2006.01) |
| ***F25D 17/06*** | (2006.01) |
| ***F25D 21/06*** | (2006.01) |
| ***F25D 21/08*** | (2006.01) |
| ***F25D 21/12*** | (2006.01) |
| ***F25D 21/14*** | (2006.01) |

(52) U.S. Cl.
CPC ..... *F25D 21/08* (2013.01); *F25D 21/12* (2013.01); *F25D 21/14* (2013.01); *F25B 2700/21173* (2013.01); *F25D 17/045* (2013.01); *F25D 2700/12* (2013.01)

(58) Field of Classification Search
USPC ..... 62/408
See application file for complete search history.

(56) References Cited

FOREIGN PATENT DOCUMENTS

| | | | |
|---|---|---|---|
| CN | 104807279 | A | 7/2015 |
| CN | 204678774 | U | 9/2015 |
| CN | 204678776 | U | 9/2015 |
| DE | 2841804 | A1 | 4/1980 |

* cited by examiner

FREEZING AND REFRIGERATING DEVICE AND DEFROSTING CONTROL METHOD THEREOF

CROSS REFERENCE TO RELATED APPLICATIONS

The present application is a 35 U.S.C. § 371 National Phase conversion of International (PCT) Patent Application No. PCT/CN2015/093403, filed on Oct. 30, 2015, which claims benefit of Chinese patent application No. 201510215962.3 filed on Apr. 29, 2015, the disclosure of which is incorporated by reference herein. The PCT International Patent Application was filed and published in Chinese.

TECHNICAL FIELD

The present invention is related to defrosting technologies of evaporators, and more particularly, to a freezing and refrigerating device and a defrosting control method thereof.

BACKGROUND

Usually, after a freezing and refrigerating device, such as a fridge or the like, operates for a certain period, the surface of its evaporator frosts. The frost affects the heat exchange between the evaporator and the air inside the fridge and reduces the refrigerating efficiency of the evaporator. Therefore, defrosting must be performed after the fridge operates for a certain period.

In the prior arts, usually defrosting of an evaporator is performed by heating. However, a lot of vapor is generated during defrosting and may enter the storage compartment of the fridge via air inlets. In this case, on one hand, heat contained in the hot air is wasted; on the other hand, the temperature in the storage compartment rises, affecting the freshness and freezing time of food.

SUMMARY

A first aspect of this invention aims to overcome at least one defect of existing freezing and refrigerating devices, and provides a freezing and refrigerating device. The freezing and refrigerating device of this invention can perform circulating defrosting to the evaporator using hot air generated by the evaporator when defrosting, so that heat contained in the hot air is sufficiently used, temperature rise in the storage compartment due to the defrosting hot air can be avoided, and preservation time of food is extended.

A further object of the first aspect of this invention is to discharge the residual hot air left after circulating defrosting is performed to the evaporator directly to the ambient space, thereby avoiding temperature fluctuations in the storage compartment due to entry of the residual hot air.

Another object of the first aspect of this invention is to reduce the energy consumption of the freezing and refrigerating device.

One object of a second aspect of this invention is to provide a defrosting control method of a freezing and refrigerating device.

According to the first aspect of this invention, this invention provides a freezing and refrigerating device, comprising a box body and a door body pivotably connected to the box body, wherein inside the box body are defined: at least one storage compartment for storing articles; an air supply path configured to supply cooling air flow to the at least one storage compartment; an air return path configured to allow the air flow from the at least one storage compartment to pass; a cooling chamber which comprises an air feeding opening part allowing air inside the cooling chamber to flow to the air supply path and an air return opening part allowing air from the air return path to enter, and contains an evaporator for cooling the air entering the cooling chamber from the air return opening part, a blower for driving the air inside the cooling chamber to flow towards the air feeding opening part, and a defrosting heater provided on the evaporator; and a defrosting air return path located behind the cooling chamber and communicating with the air feeding opening part and the air return opening part of the cooling chamber, wherein the air supply path and the defrosting air return path are provided with an air supply door and a defrosting air return door respectively to selectively connect or block the air supply path and the defrosting air return path.

Optionally, the freezing and refrigerating device further comprises an air discharging path communicating with the defrosting air return path and an ambient space to allow the air passing the defrosting air return path to be discharged to the ambient space directly.

Optionally, the air discharging path is provided with an air discharging door therein to selectively connect or block the air discharging path, and one end of the air discharging path communicating with the defrosting air return path is located upstream of the defrosting air return door in the air flowing direction.

Optionally, the at least one storage compartment comprises a freezing compartment, the air supply path comprises a freezing air inlet provided to a rear cover plate of the freezing compartment, and the air return path comprises a freezing air return passage located at a lower part of the freezing compartment.

Optionally, the at least one storage compartment comprises a refrigerating compartment and a freezing compartment that are provided in a vertical direction relative to each other, and the cooling chamber is located behind the freezing compartment and is separated therefrom by a rear cover plate of the freezing compartment.

Optionally, the air supply path comprises a refrigerating air feeding passage located behind the refrigerating compartment and a freezing air inlet provided at the rear cover plate of the freezing compartment, and the air supply door comprises a refrigerating air feeding door provided inside the refrigerating air feeding passage and a freezing air feeding door provided at the freezing air inlet.

Optionally, a top of the evaporator is provided with a first temperature sensor to detect a temperature of the top of the evaporator.

Optionally, one end of the defrosting air return path communicating with the cooling chamber is located downstream of the blower in the air flowing direction.

Optionally, the defrosting heater is provided on the bottom of the evaporator and faces a groove provided in the bottom of the cooling chamber, such that defrosting water generated during defrosting flows into a water collecting box provided at the bottom of the box body via a water discharging pipe communicating with the groove.

According to the second aspect of this invention, this invention also provides a defrosting control method of a freezing and refrigerating device, the method comprising: step A: receiving a defrosting signal instructing the evaporator located inside the cooling chamber of the freezing and refrigerating device to perform defrosting; step B: starting the defrosting heater located on the evaporator; step C:

closing the air supply door located in the air supply path of the freezing and refrigerating device to block the air supply path; and step D: opening the defrosting air return door located in the defrosting air return path of the freezing and refrigerating device to connect the defrosting air return path, such that hot air generated by the defrosting heater when performing heating and defrosting sequentially passes the air feeding opening part of the cooling chamber, the defrosting air return path, and the air return opening part of the cooling chamber, and returns to the evaporator, and circulating defrosting is performed to the evaporator using the hot air.

Optionally, after the step D, the method further comprises step E: when the temperature of the top of the evaporator reaches a predetermined temperature, stopping the defrosting heater.

Optionally, after the step E, the method further comprises step F: closing the defrosting air return door to block the defrosting air return path; and step G: opening the air discharging door in the air discharging path of the freezing and refrigerating device to connect the air discharging path such that residual hot air generated during circulating defrosting is directly discharged to the ambient space via the air discharging path.

Optionally, after the step the method further comprises step H: when the defrosting heater is stopped for a predetermined time period, closing the air discharging door to block the air discharging path.

In the freezing and refrigerating device of this invention, as the air supply path communicating with the cooling chamber and the storage compartment is provided with an air supply door, and the defrosting air return path communicating with the air feeding opening part of the cooling chamber and the air return opening part thereof is provided with a defrosting air return door, when defrosting is performed to the evaporator in the cooling chamber, the air supply door can block the air supply path, preventing the hot air generated when the defrosting heater heats and defrosts from flowing into the storage compartment via the air supply path, preventing the temperature in the storage compartment from increasing due to the defrosting hot air, and extending the preservation time of food. In addition, the defrosting air return path can be opened by the defrosting air return door, so that hot air generated by defrosting sequentially passes the air feeding opening part, the defrosting air return path, and the air return opening part, and returns to the evaporator in the cooling chamber, and circulating defrosting can be performed to the evaporator using the hot air. In this way, heat contained in the hot air is sufficiently utilized, and the defrosting efficiency of the evaporator is improved.

Further, as the freezing and refrigerating device of this invention comprises an air discharging path communicating with the cooling chamber and the ambient space, and the air discharging path is provided with an air discharging door, after the circulating defrosting performed for the evaporator ends, the air discharging path can be opened by the air discharging door, so that the residual hot air left after the circulating defrosting performed for the evaporator ends is directly discharged to the ambient space via the air discharging path, and temperature fluctuations in the storage compartment due to entry of the residual hot air are avoided.

Further, as the freezing and refrigerating device of this invention can sufficiently utilize the hot air generated when the defrosting heater performs heating and defrosting for the evaporator, and discharge the residual hot air after the defrosting ends to the ambient space, the defrosting operations of the evaporator hardly affect the temperature in the storage compartment. After the defrosting for the evaporator ends, if refrigerating is performed to the storage compartment again, the temperature in the storage compartment can be restored to the temperature before the defrosting is performed in a short period, thereby reducing the energy consumption of the freezing and refrigerating device.

The above and other objects, advantages and features of the invention will be understood by those skilled in the art more clearly with reference to the detailed description of the embodiments of this invention below with reference to the accompanying drawings.

BRIEF DESCRIPTION OF THE DRAWINGS

The followings will describe some embodiments of this invention in detail in an exemplary rather than restrictive manner with reference to the accompanying drawings. The same reference signs in the drawings represent the same or similar parts. Those skilled in the art shall understand that these drawings are only schematic ones of this invention, and may not be necessarily drawn according to the scales. In the drawings.

DETAILED DESCRIPTION

Figure 1:
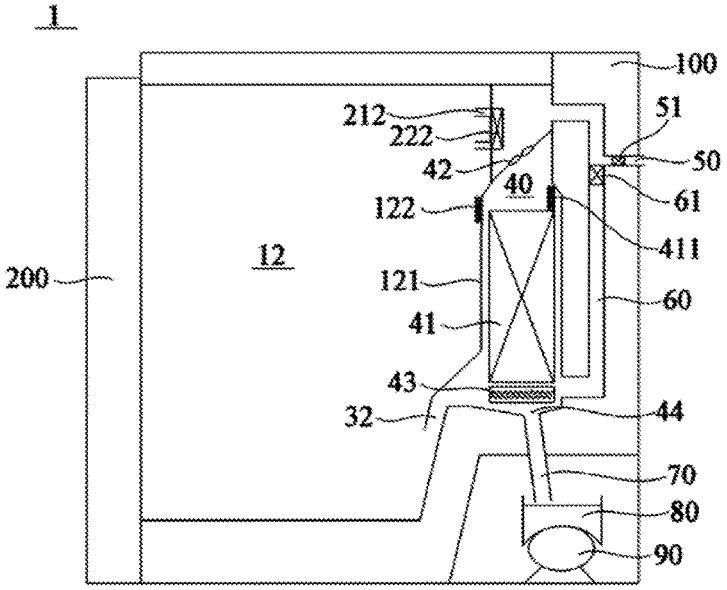
FIG. 1 is a schematic view of a freezing and refrigerating device according to an embodiment of this invention.

FIG. 1 is a schematic view of a freezing and refrigerating device according to an embodiment of this invention. As shown in FIG. 1, the freezing and refrigerating device 1 comprises a box body 100 and a door body 200 pivotably connected to the box body 100. Inside the box body 100 are defined: at least one storage compartment for storing articles, an air supply path, an air return path and a cooling chamber 40. The air supply path is configured to supply cooling air flow to the at least one storage compartment. The air return path is configured to allow the air flow from the at least one storage compartment to pass. The cooling chamber 40 comprises an air feeding opening part allowing air inside the cooling chamber to flow to the air supply path and an air return opening part allowing air from the air return path to enter, and contains an evaporator 41 for cooling the air entering the cooling chamber from the air return opening part, a blower 42 for driving the air inside the cooling chamber 40 to flow towards the air feeding opening part, and a defrosting heater 43 provided on the evaporator 41. In particular, the box body 100 further defines a defrosting air return path 60 located behind the cooling chamber 40 and communicating with the air feeding opening part and the air return opening part of the cooling chamber 40. The air supply path and the defrosting air return path 60 are provided therein with an air supply door and a defrosting air return door 61 respectively to selectively connect or block the air supply path and the defrosting air return path 60.

In the freezing and refrigerating device 1 of this invention, as the air supply path communicating with the cooling chamber 40 and the storage compartment is provided with an air supply door, and the defrosting air return path 60 communicating with the air feeding opening part of the cooling chamber 40 and the air return opening part thereof is provided with a defrosting air return door 61, when defrosting is performed to the evaporator 41 in the cooling chamber 40, the air supply door can block the air supply path, preventing the hot air generated when the defrosting heater 43 heats and defrosts from flowing into the storage compartment via the air supply path, preventing the temperature in the storage compartment from increasing due to the defrosting hot air, and extending the preservation time of food. In addition, the defrosting air return path 60 can be opened by the defrosting air return door 61, so that hot air generated by defrosting sequentially passes the air feeding opening part, the defrosting air return path 60, and the air return opening part, and returns to the evaporator 41 in the cooling chamber 40, and circulating defrosting can be performed to the evaporator 41 using the hot air. In this way, heat contained in the hot air is sufficiently utilized.

In some embodiments of this invention, as shown in FIG. 1, the freezing and refrigerating device 1 further comprises an air discharging path 50 communicating with the defrosting air return path 60 and an ambient space to allow the air passing the defrosting air return path 60 to be discharged to the ambient space directly.

Further, the air discharging path 50 is provided with an air discharging door 51 therein to selectively connect or block the air discharging path 50. After the circulating defrosting for the evaporator 41 ends, there may be residual hot air in the defrosting air return path 60 and the cooling chamber 40. Therefore, the air discharging path 50 may be opened by the air discharging door 51, so that the residual hot air left after the circulating defrosting performed for the evaporator 41 ends is discharged to the ambient space via the air discharging path 50, and temperature fluctuations in the storage compartment due to entry of the residual hot air are avoided.

Further, one end of the air discharging path 50 communicating with the defrosting air return path 60 is located upstream of the defrosting air return door 61 in the air flowing direction. Thus, after the circulating defrosting performed for the evaporator 41 ends, if the defrosting air return door 61 in the defrosting air return path 60 is closed to block the defrosting air return path 60, the air discharging path 50 is not blocked. That is, the defrosting air return door 61 can separate the defrosting air return path 60 into an upstream part and a downstream part in the air flowing direction. The end of the air discharging path 50 communicating with the defrosting air return path 60 is located upstream of the defrosting air return path 60, so that when the defrosting air return door 61 is closed, the upstream part of the defrosting air return path can still communicate with the air discharging path 50.

In some embodiments of this invention, one end of the defrosting air return path 60 communicating with the cooling chamber 40 is located downstream of the blower 42 in the air flowing direction. Thus, when the evaporator 41 needs defrosting, the blower 42 may continue working at a low power to drive the hot air generated by defrosting to return to the bottom of the cooling chamber 40 via the defrosting air return path 60 located downstream of the blower 42, saving an additional driving member and simplifying the structure of the freezing and refrigerating device 1.

In some embodiments of this invention, as shown in FIG. 1, in the freezing and refrigerating device 1 of this invention, the at least one storage compartment comprises a freezing compartment 12. The air supply path comprises a freezing air inlet 212 provided to a rear cover plate 121 of the freezing compartment 12, and the air return path comprises a freezing air return passage 32 located at the bottom of the freezing compartment 12. The air supply door comprises a freezing air feeding door 222 provided at the freezing air inlet 212. That is, the cooling chamber 40 communicates with the freezing compartment 12 via the freezing air inlet 212.

Specifically, the cooling chamber 40 supplies cooling air flow to the freezing compartment 12 via the air feeding opening part. In this embodiment, the air feeding opening part may comprise a freezing air feeding opening communicating with the freezing air inlet 212. The freezing air feeding opening is located downstream of the evaporator 41 in the air flowing direction to allow the air cooled by the evaporator 41 to pass. The air return opening part of the cooling chamber 40 comprises a freezing air return opening communicating with the freezing air return passage 32. The freezing air return opening is located upstream of the evaporator 41 in the air flowing direction to guide the air from the freezing compartment 12 to the evaporator 41 for cooling.

In some embodiments of this invention, a top of the evaporator 41 is provided with a first temperature sensor 411 to detect a temperature of the top of the evaporator 41. When the temperature of the top of the evaporator 41 reaches a first predetermined temperature, it is determined that defrosting of the evaporator 41 ends. Therefore, the defrosting heater 43 can be controlled automatically to stop heating the evaporator 41 based on the temperature data detected by the first temperature sensor 411 to realize smart control.

Further, a rear cover plate of the freezing compartment 12 may be provided with a third temperature sensor 122 to detect the temperature in the freezing compartment 12.

In some embodiments of this invention, the defrosting heater 43 may be provided on the bottom of the evaporator 41 and faces a groove 44 provided in the bottom of the cooling chamber 40, such that defrosting water generated during defrosting flows into a water collecting box 80 provided at the bottom of the box body 100 via a water discharging pipe 70 communicating with the groove 44. The water collecting box 80 is provided on a compressor 90. When the compressor 90 works, water in the water collecting box 80 is evaporated by the heat generated by the compressor.

Figure 2:
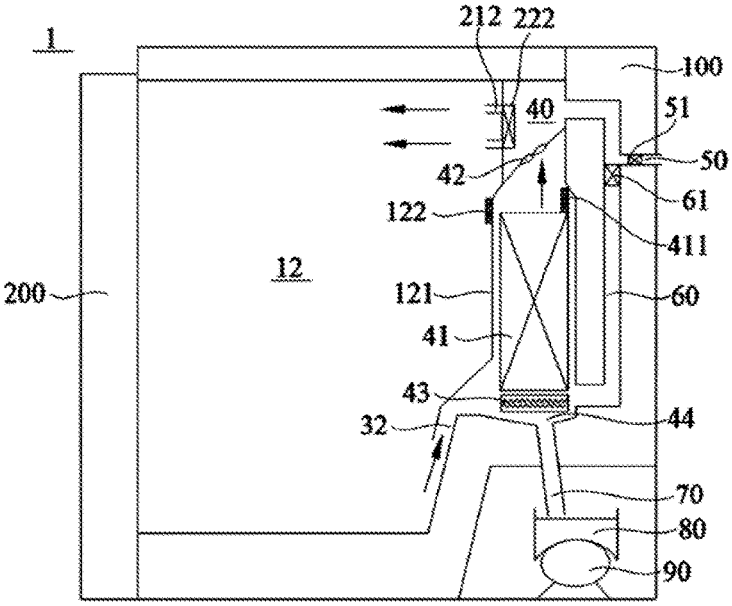
FIG. 2 is a schematic view of a freezing and refrigerating device in a refrigerating state according to an embodiment of this invention.

FIG. 2 is a schematic view of a freezing and refrigerating device in a refrigerating state according to an embodiment of this invention. The arrows in this figure represent the air flowing directions. When the freezing and refrigerating device 1 is in a refrigerating state, the compressor 90, the evaporator 41 and the blower 42 are in operation states. The freezing air feeding door 222 is opened to connect the freezing air inlet 212. The air flow cooled by the evaporator 41 sequentially passes the freezing air feeding opening, the freezing air feeding door 222 and the freezing air inlet 212 of the cooling chamber 40, and flows into the freezing compartment 12. The air in the freezing compartment 12 passes the freezing air return passage 32 to return to the air return opening part of the cooling chamber 40, is cooled by the evaporator 41 and flows into the freezing compartment 12 again. Thus, the air circulation path in the freezing compartment 12 is formed. In addition, the defrosting air return door 61 is closed to block the defrosting air return path 60. The air discharging door 51 is closed to block the air discharging path 50 and prevent the air flow cooled by the evaporator 41 from flowing to the ambient space.

Further, when the third temperature sensor 122 detects that the temperature in the freezing compartment 12 reaches a third predetermined value, the freezing and refrigerating device 1 may control the freezing air feeding door 222 to close, thereby realizing automatic control of the cooling of the storage compartment.

Figure 3:
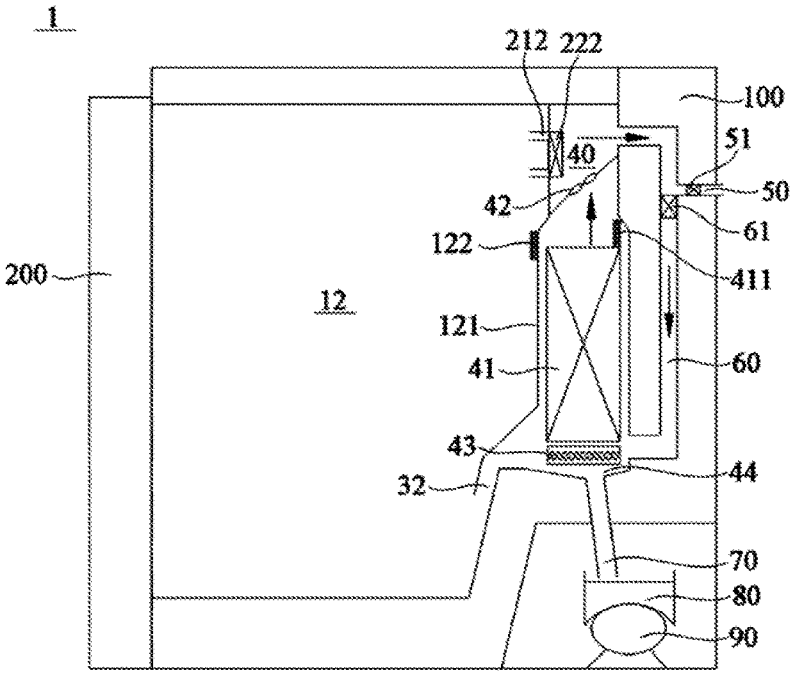
FIG. 3 is a schematic view of a freezing and refrigerating device in a circulating defrosting state according to an embodiment of this invention.

FIG. 3 is a schematic view of a freezing and refrigerating device in a circulating defrosting state according to an embodiment of this invention. The arrows in this figure represent the air flowing directions. When the freezing and refrigerating device 1 is in a circulating defrosting state, the compressor 90 and the evaporator 41 are stopped, and the blower 42 works at a low power. The defrosting heater 43 is started to heat the evaporator 41. The defrosting air return door 61 is opened, such that the hot air generated when the defrosting heater 43 performs heating and defrosting for the evaporator 41 returns to the bottom of the evaporator 41 located in the cooling chamber 40 via the defrosting air return path 60, and the hot air can be used again to perform circulating defrosting for the evaporator 41. In addition, the air discharging door 51 is closed to prevent the hot air from directly flowing to the ambient space. The freezing air feeding door 222 is closed to block the freezing air inlet 212, preventing the hot air generated by defrosting from entering the freezing compartment 12 and avoiding influence to food preservation due to temperature fluctuations.

Figure 4:
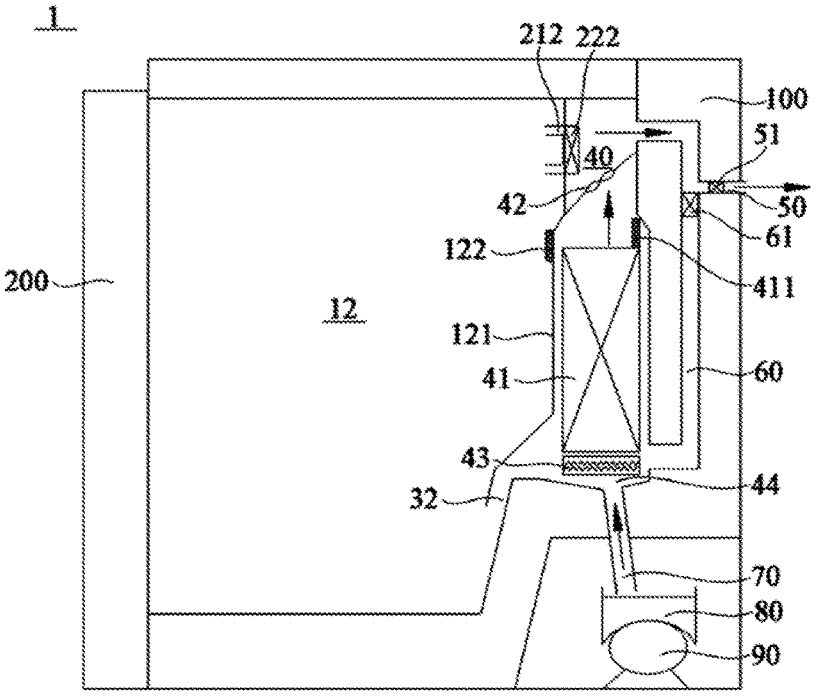
FIG. 4 is a schematic view of a freezing and refrigerating device in an air discharging state according to an embodiment of this invention.

FIG. 4 is a schematic view of a freezing and refrigerating device in an air discharging state according to an embodiment of this invention. The arrows in this figure represent the air flowing directions. As shown in FIG. 4, after defrosting for the evaporator 41 ends, there may be residual hot air in the defrosting air return path 60 and the cooling chamber 40. Therefore, the freezing air feeding door 222 may keep closing, the defrosting air return door 61 is closed, and the air discharging door 51 in the air discharging path 50 is opened, so that the residual hot air is directly discharged to the ambient space via the air discharging path 50. The air in the ambient space may enter the cooling chamber 40 sequentially via the water collecting box 80, the water discharging pipe 70 and the groove 44 to form an air circulation path when the freezing and refrigerating device discharges air. Further, when the freezing and refrigerating device 1 discharges air, the blower 42 may stop, and the residual hot air generated during circulating defrosting may be discharged to the ambient space via the air discharging path 50 in a natural heat radiation manner. Preferably, the blower 42 may work at a low power, so that the residual hot air is discharged to the ambient space via the air discharging path 50 in a compulsory manner.

Thus, the freezing and refrigerating device 1 of this invention can sufficiently use the hot air generated when the defrosting heater 43 performs heating and defrosting for the evaporator 41, and discharge the residual hot air after the defrosting ends to the ambient space, so that the defrosting operations of the evaporator 41 hardly affect the temperature in the storage compartment. After the defrosting for the evaporator 41 ends, if refrigerating is performed to the storage compartment, the temperature in the storage compartment can be restored to the temperature before the defrosting is performed in a short period, thereby reducing the energy consumption of the freezing and refrigerating device 1.

Figure 5:
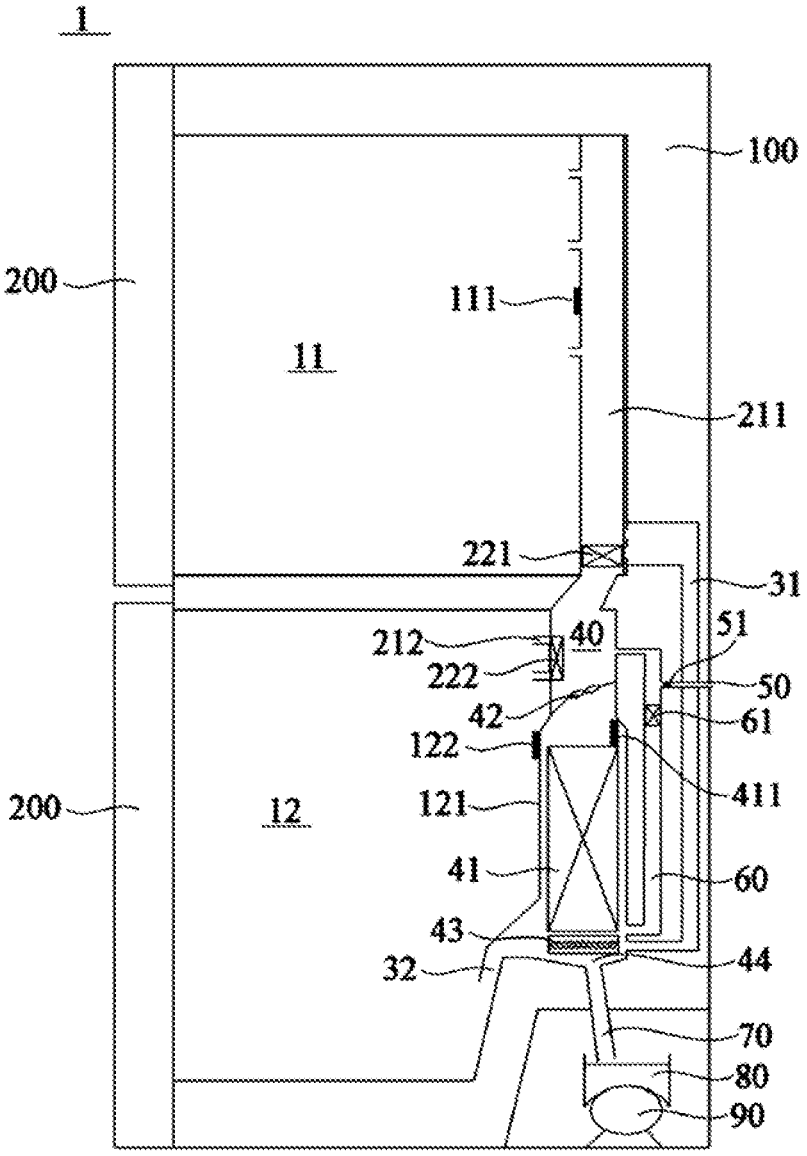
FIG. 5 is a schematic view of a freezing and refrigerating device according to another embodiment of this invention.

FIG. 5 is a schematic view of a freezing and refrigerating device according to another embodiment of this invention. As shown in FIG. 5, in other embodiments of this invention, the at least one storage compartment comprises a refrigerating compartment 11 and a freezing compartment 12 that are provided in a vertical direction relative to each other, and the cooling chamber 40 is located behind the freezing compartment 12 and is separated therefrom by a rear cover plate 121 of the freezing compartment 12. The air supply path comprises a refrigerating air feeding passage 211 located behind the refrigerating compartment 11 and a freezing air inlet 212 provided at the rear cover plate 121 of the freezing compartment 12, and the air supply door comprises a refrigerating air feeding door 221 provided inside the refrigerating air feeding passage 211 and a freezing air feeding door 222 provided at the freezing air inlet 212. That is, in the embodiments of this invention, the cooling chamber 40 communicates with the refrigerating compartment 11 and the freezing compartment 12 via the refrigerating air feeding passage 211 and the freezing air inlet 212 respectively.

Further, the cooling chamber 40 comprises an air feeding opening part communicating with the air supply path to supply cooling air flow to the at least one storage compartment via the air feeding opening part. Specifically, the air feeding opening part comprises a refrigerating air feeding opening communicating with an air inlet end of the refrigerating air feeding passage 211 and a freezing air feeding opening communicating with the freezing air inlet 212. The refrigerating air feeding opening and the freezing air feeding opening are located downstream of the evaporator 41 in the air flowing direction to allow the air cooled by the evaporator 41 to pass. Further, the refrigerating air feeding door 221 may be provided at the air inlet end of the refrigerating air feeding passage 211. Those skilled in the art shall understand that in other embodiments of this invention, the refrigerating air feeding door 221 may be provided at any position in the refrigerating air feeding passage 211, or at an air inlet of the refrigerating compartment 11.

In some embodiments of this invention, the air return passage may comprise a refrigerating air return passage 31 and a freezing air return passage 32. The air return opening part of the cooling chamber 40 may comprise a refrigerating air return opening communicating with the refrigerating air return passage 31 and a freezing air return opening communicating with the freezing air return passage 32. The air return opening part is located upstream of the evaporator 41 in the air flowing direction, or the refrigerating air return opening and the freezing air return opening are located upstream of the evaporator 41 in the air flowing direction, to guide the air from the refrigerating compartment 11 and the freezing compartment 12 to the evaporator 41 for cooling. The refrigerating air return passage 31 extends from the bottom of the refrigerating compartment 11 to the air return opening part of the cooling chamber 40.

Further, rear cover plates of the refrigerating compartment 11 and the freezing compartment 12 may be provided with a second temperature sensor 111 and a third temperature sensor 122 respectively to detect the temperatures in the refrigerating compartment 11 and the freezing compartment 12 respectively.

Other structural features of the freezing and refrigerating device in other embodiments of this invention are the same as the box body in the embodiment shown in FIG. 1, and will not be repeated.

Figure 6:
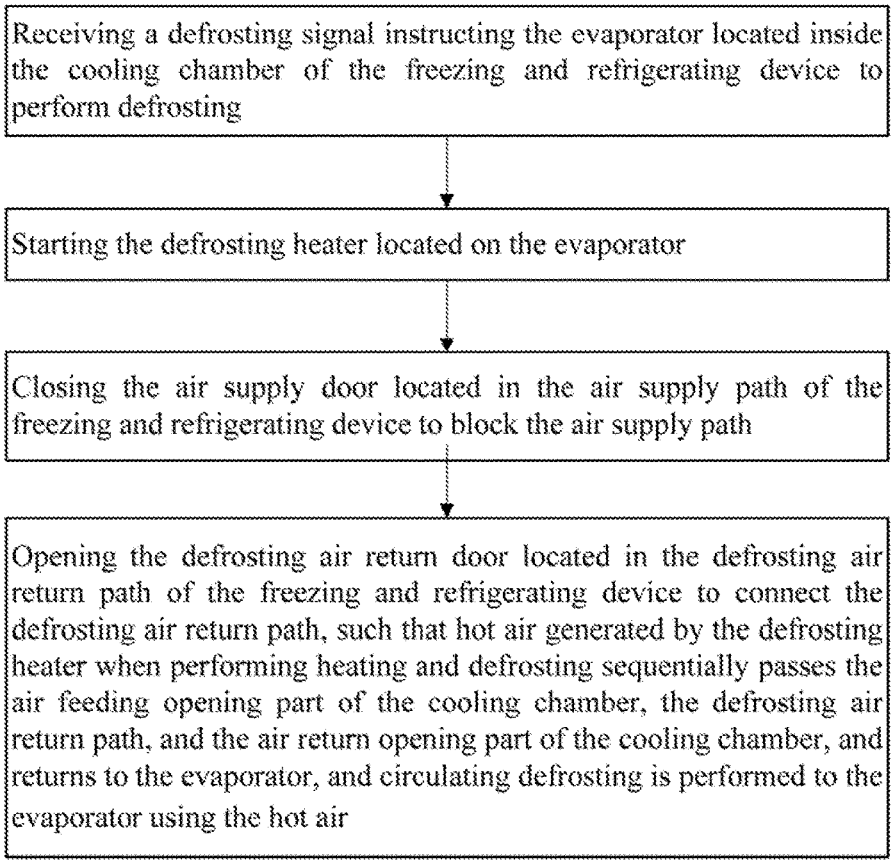
FIG. 6 is a flow chart of a defrosting control method of a freezing and refrigerating device according to an embodiment of this invention.

FIG. 6 is a flow chart of a defrosting control method of a freezing and refrigerating device according to an embodiment of this invention. In this embodiment, the defrosting control method comprises: step A: receiving a defrosting signal instructing the evaporator 41 located inside the cooling chamber 40 of the freezing and refrigerating device 1 to perform defrosting; step B: starting the defrosting heater 43 located on the evaporator 41; step C: closing the air supply door located in the air supply path of the freezing and refrigerating device 1 to block the air supply path; and step D: opening the defrosting air return door 61 located in the defrosting air return path 60 of the freezing and refrigerating device 1 to connect the defrosting air return path 60, such that hot air generated by the defrosting heater 43 when performing heating and defrosting sequentially passes the air feeding opening part of the cooling chamber 40, the defrosting air return path 60, and the air return opening part of the cooling chamber 40, and returns to the evaporator 41, and circulating defrosting is performed to the evaporator 41 using the hot air.

Those skilled in the art shall understand that in this embodiment, there is no chronological order between the steps C and D. In other words, after starting the defrosting heater 43, the air supply door may be closed, and then the defrosting air return door 61 is opened; or the defrosting air return door 61 is opened first, and then the air supply door is closed. In this embodiment, preferably, the air supply door is closed first, and then the defrosting air return door 61 is opened.

Figure 7:
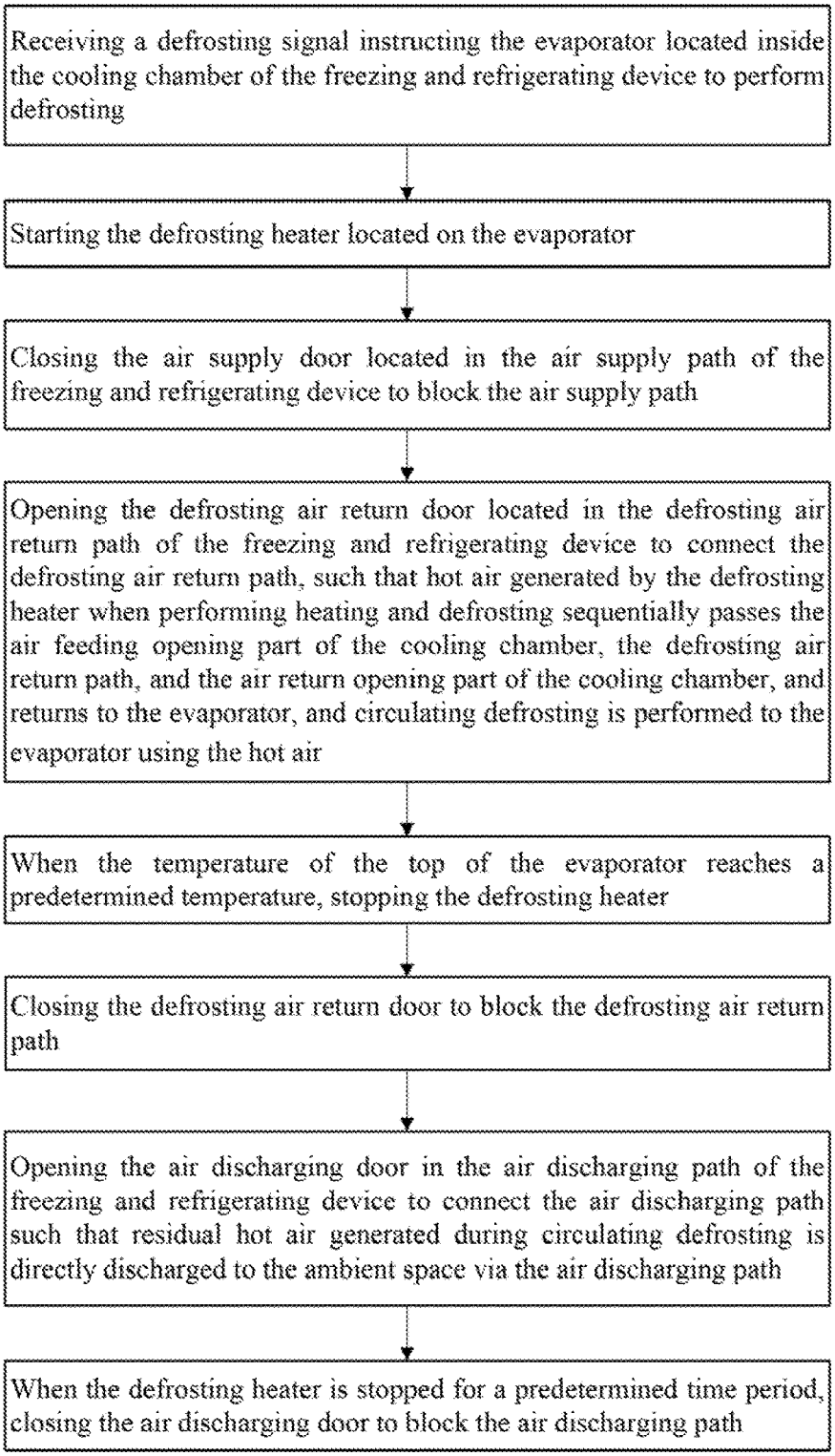
FIG. 7 is a flow chart of a defrosting control method of a freezing and refrigerating device according to another embodiment of this invention.

FIG. 7 is a flow chart of a defrosting control method of a freezing and refrigerating device according to another embodiment of this invention. In other embodiments, after the step D, the method further comprises step E: when the temperature of the top of the evaporator 41 reaches the first predetermined temperature, stopping the defrosting heater 43. In this step, the first temperature sensor 411 provided at the top of the evaporator 41 may detect the temperature of the top of the evaporator 41. The first predetermined temperature may be the temperature when defrosting for the evaporator 41 ends.

Further, in some embodiments of this invention, after the step E, the method further comprises step F: closing the defrosting air return door 61 to block the defrosting air return path 60; and step G: opening the air discharging door 51 in the air discharging path 50 of the freezing and refrigerating device 1 to connect the air discharging path 50 such that residual hot air generated during circulating defrosting is directly discharged to the ambient space via the air discharging path 50. Thus, temperature fluctuations in the storage compartment due to entry of the residual hot air generated during circulating defrosting are avoided.

Further, after the step the method further comprises step H: when the defrosting heater 43 is stopped for a predetermined time period, closing the air discharging door 51 to block the air discharging path 50. When the defrosting heater 43 is stopped for a predetermined time period, the residual hot air generated during defrosting and heating of the evaporator 41 is basically completely discharged to the ambient space. Closing the air discharging door 51 at this time can prevent excessive heat exchange between the air in the freezing and refrigerating device and the air in the ambient space, and improve the cooling performance of the freezing and refrigerating device.

Those skilled in the art shall understand that the freezing and refrigerating device 1 of this invention may be a fridge, a refrigerating cabinet, a wine cabinet, a refrigerating tank or other devices having a freezing or refrigerating function or having a freezing or refrigerating compartment.

Although multiple embodiments of this invention have been illustrated and described in detail, those skilled in the art may make various modifications and variations to the invention based on the content disclosed by this invention or the content derived therefrom without departing from the spirit and scope of the invention. Thus, the scope of this invention should be understood and deemed to include these and other modifications and variations.

What is claimed is:

1. A defrosting control method of a freezing and refrigerating device, the freezing and refrigerating device comprising a box body and a door body pivotably connected to the box body, wherein inside the box body are defined:

at least one storage compartment for storing articles;

an air supply path configured to supply cooling air flow to the at least one storage compartment an air return path configured to allow the air flow from the at least one storage compartment to pass;

a cooling chamber which comprises an air feeding opening part allowing air inside the cooling chamber to flow to the air supply path and an air return opening part allowing air from the air return path to enter, and contains an evaporator for cooling the air entering the cooling chamber from the air return opening part, a blower for driving the air inside the cooling chamber to flow towards the air feeding opening part, and a defrosting heater provided on the evaporator; and a defrosting air return path located behind the cooling chamber and communicating with the air feeding opening part and the air return opening part of the cooling chamber; wherein the air supply path and the defrosting air return path are provided with an air supply door and a defrosting air return door respectively to selectively connect or block the air supply path and the defrosting air return path;

the method comprising:

step A: receiving a defrosting signal instructing the evaporator located inside the cooling chamber of the freezing and refrigerating device to perform defrosting;

step B: starting the defrosting heater located on the evaporator;

step C: closing the air supply door located in the air supply path of the freezing and refrigerating device to block the air supply path; and step D: opening the defrosting air return door located in the defrosting air return path of the freezing and refrigerating device to connect the defrosting air return path, such that hot air generated by the defrosting heater when performing heating and defrosting sequentially passes the air feeding opening part of the cooling chamber, the defrosting air return path, and the air return opening part of the cooling chamber, and returns to the evaporator, and circulating defrosting is performed to the evaporator using the hot air.

2. The defrosting control method of claim 1, after the step D, further comprising: step E: when the temperature of the top of the evaporator reaches a predetermined temperature, stopping the defrosting heater.

3. The defrosting control method of claim 2, after the step E, further comprising:

step F: closing the defrosting air return door to block the defrosting air return path; and step G: opening the air discharging door in the air discharging path of the freezing and refrigerating device to connect the air discharging path such that residual hot air generated during circulating defrosting is directly discharged to the ambient space via the air discharging path.

4. The defrosting control method of claim 3, after the step G, further comprising: step H: when the defrosting heater is stopped for a predetermined time period, closing the air discharging door to block the air discharging path.

* * * * *